United States Patent [19]

Jacobi

[11] Patent Number: 4,984,591

[45] Date of Patent: Jan. 15, 1991

[54] ORTHOGONALLY ASYMMETRIC GEOMETRIC HAIR ROLLERS

[75] Inventor: Gerald M. Jacobi, Pomona, N.Y.

[73] Assignee: Conair Corporation, Stamford, Conn.

[21] Appl. No.: 209,207

[22] Filed: Jun. 20, 1988

[51] Int. Cl.[5] ..... A45D 4/00; A45D 2/12

[52] U.S. Cl. ..... 132/229; 132/226; 219/222; 219/242

[58] Field of Search ..... 132/227, 229, 233, 223, 132/226, 237, 245, 248, 249, 250, 251, 252, 253, 254, 255, 256, 257, 258, 259, 260, 261, 262, 263, 269, 117, 118; 219/222, 225, 242

[56] References Cited

U.S. PATENT DOCUMENTS

| | | | |
|---|---|---|---|
| 781,246 | 1/1905 | Wallace, Jr. | 132/117 |
| 1,510,359 | 9/1924 | Van Gale | 132/233 |
| 1,922,061 | 8/1933 | Stroher | 132/229 |
| 2,762,382 | 9/1956 | Morgan, Sr. | 219/222 |
| 2,781,045 | 2/1957 | Rosch | 132/223 |
| 3,610,878 | 10/1971 | Thomas | 132/229 |

*Primary Examiner*—Gene Mancene
*Assistant Examiner*—Adriene J. Lepiane
*Attorney, Agent, or Firm*—Haynes N. Johnson

[57] ABSTRACT

A hair setter unit for providing unusual forms of hair curling including a base and a plurality of heating posts on the base, a plurality of hair rollers having axial bores therein and fitting about the heating posts, the rollers having orthogonally asymmetrical cross-sections, and at least some of the rollers having different cross-sections than other of the rollers, such as rhombic, elliptical, and triangular, and spaced teeth along axially-aligned edges of the rollers.

5 Claims, 4 Drawing Sheets

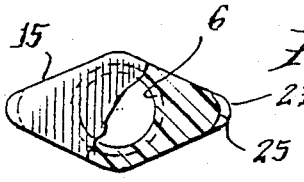
Fig. 19.
Fig. 18.
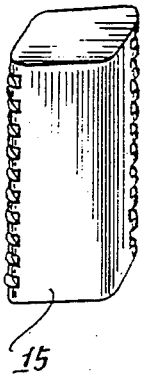
Fig. 20
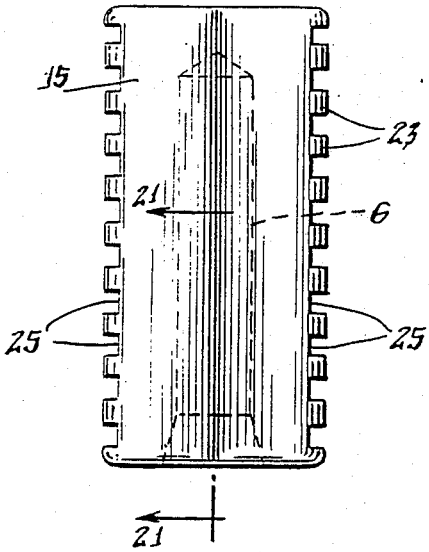
Fig. 21.
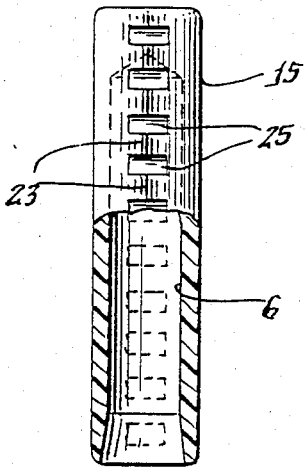
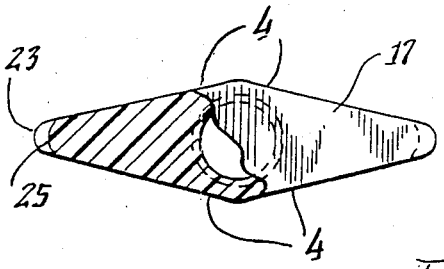
Fig. 23.
Fig. 22
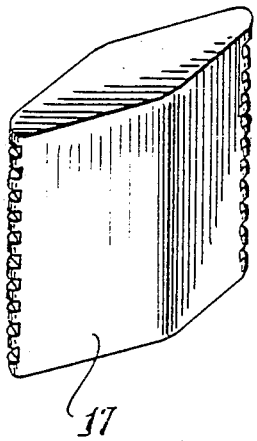
Fig. 24
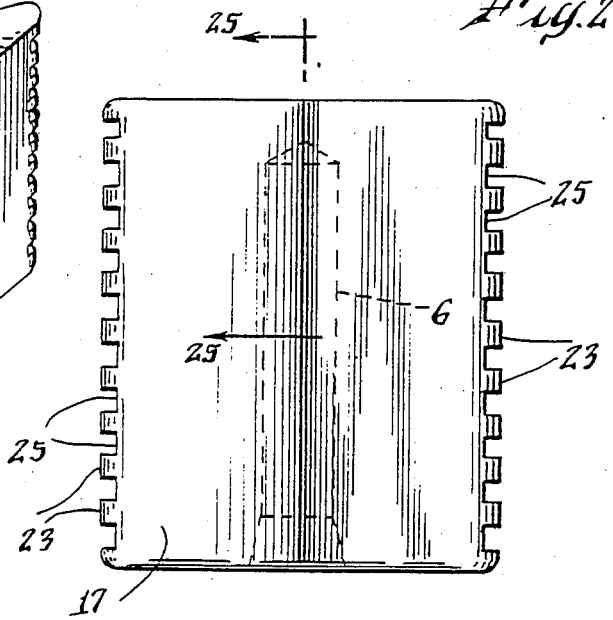
Fig. 25.
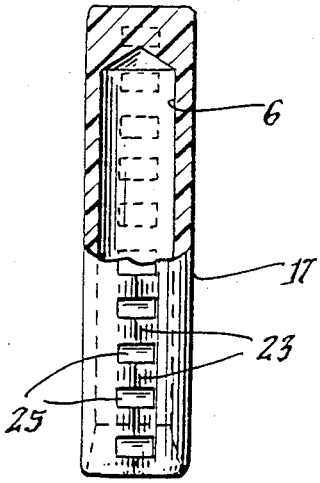

ORTHOGONALLY ASYMMETRIC GEOMETRIC HAIR ROLLERS

FIELD OF THE INVENTION

This invention relates to the field of hair rollers. More particularly, it relates to the field of rollers made to create a particular pattern of wave to the hair.

It is directed to rollers having a unique cross-section formed of certain geometric patterns.

BACKGROUND OF THE INVENTION

Hair rollers have in the past normally had a round cross-section, i.e., they have been for rolling hair. They are usually heated by being placed over heating posts in a hair setter unit.

Though it has sometimes been considered advantageous to use other than round shapes in hair curlers, this apparently has not been the practice in hair rollers. Thus, for example, other than round shapes have been used in Nicol Ser. No. 459,146, Russell U.S. Pat. No. 1,397,332, Morenilla U.S. Pat. No. 1,486,786, Porter U.S. Pat. No. 3,516,420, and Demetrio U.S. Pat. No. 3,955,064. None of these patents are directed to hair rollers and none to the particular geometric structure used in my invention.

BRIEF SUMMARY OF THE INVENTION

My invention is a hair setter which allows the user to obtain curls of an unusual shape, not limited by the shapes resulting from round rollers.

A series of hair rollers are provided which have a geometric shape which I call "orthogonal asymmetry". By this I mean that, when viewed in a plane transverse to that of the roller axis, there can be one line which divides the section into mirror images, but, on a line in the plane and perpendicular (orthogonal) to the first line, the sections will be asymmetric relative to the first images, i.e., different than the first images. Thus, for example, a rhombic or triangular cross-section would satisfy this definition. This asymmetrical structure serves to provide unusual angular corners for different bending of the hair.

In addition, the rollers have evenly-spaced teeth on their most acute edges. This makes it easier to wind hair evenly around them, and allows the rollers to be made without flanges on their ends.

By having this pattern of orthogonally asymmetrical cross-sections, the heating posts of the hair setter may be positioned closer together, providing for a more compact unit.

DESCRIPTION OF THE DRAWINGS

FIGS. 18 through 21 are similar, except directed to a roller having a rhombic cross-section.

FIGS. 22 through 25 are similar, except directed to a rhombic cross-section having a larger length to width ratio.

DETAILED DESCRIPTION OF THE INVENTION

Figure 1:
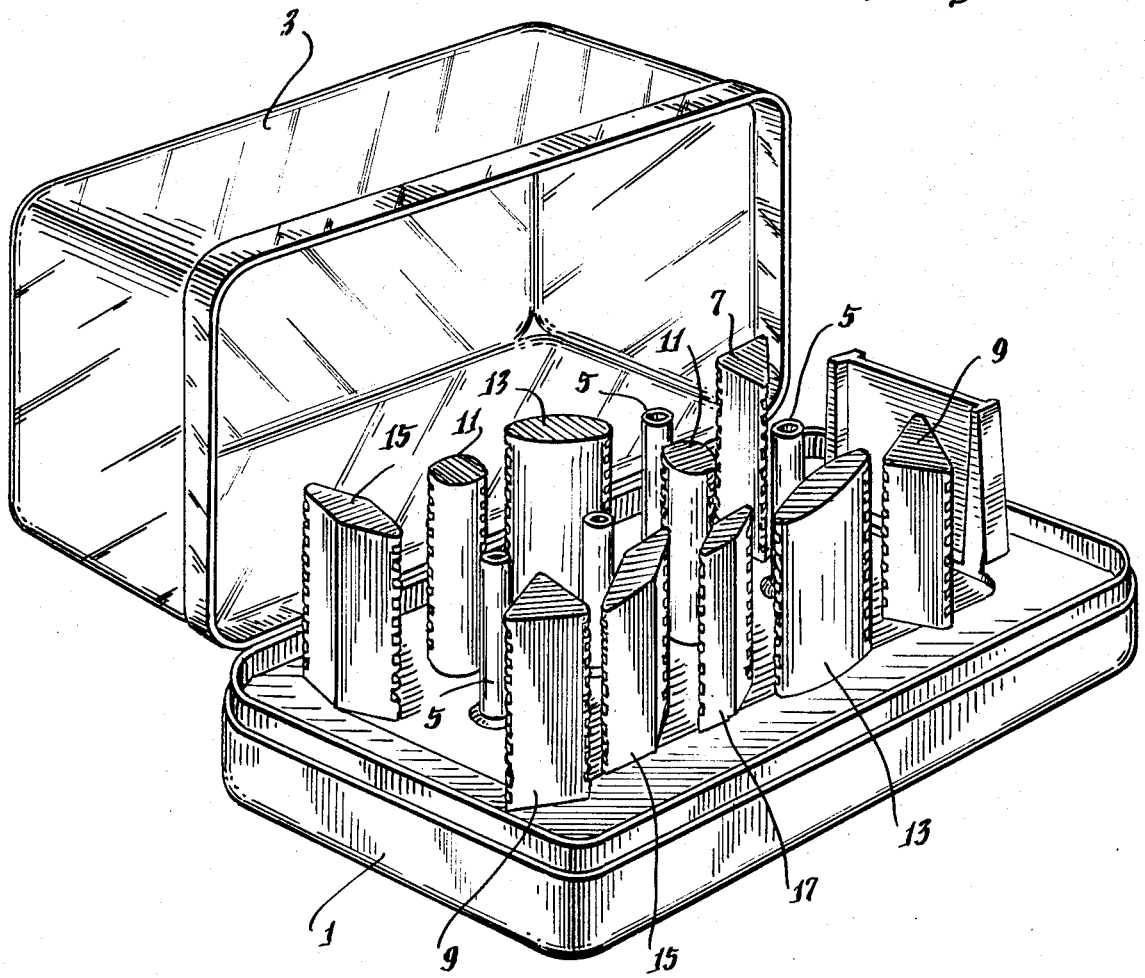
FIG. 1 is a perspective view of a hair setter with the uniquely-shaped rollers on most of the heating pins.
Figure 2:
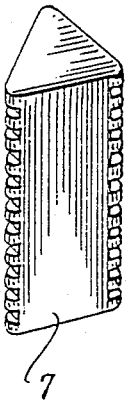
FIG. 2 is a roller having a triangular cross-section.
Figure 3:
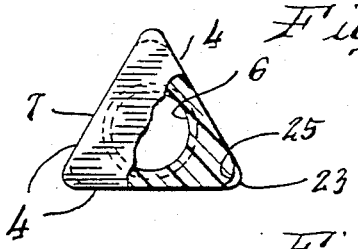
FIG. 3 is a top plan view, partially in section, of the roller of FIG. 2.
Figure 4:
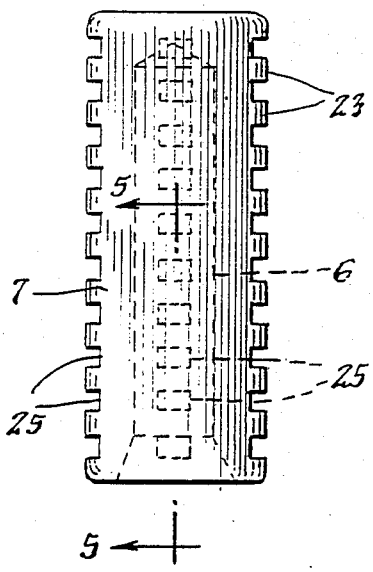
FIG. 4 is a side elevation of that roller.
Figure 5:
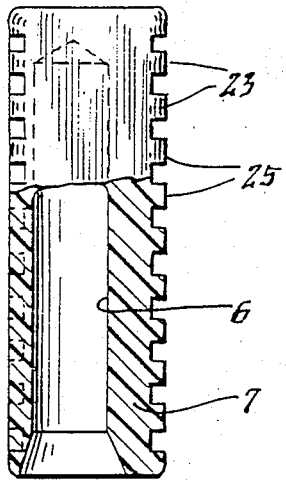
FIG. 5 is a partial section taken on line 5—5 of FIG. 4.
Figure 6:
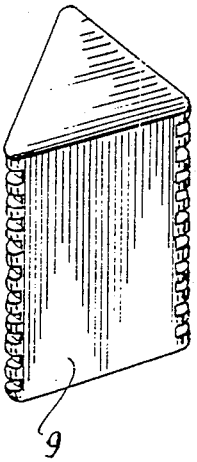
FIGS. 6 through 8 are similar to FIGS. 2 through 5, except depicting a larger roller.
Figure 7:
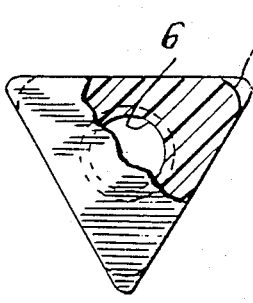
Figure 8:
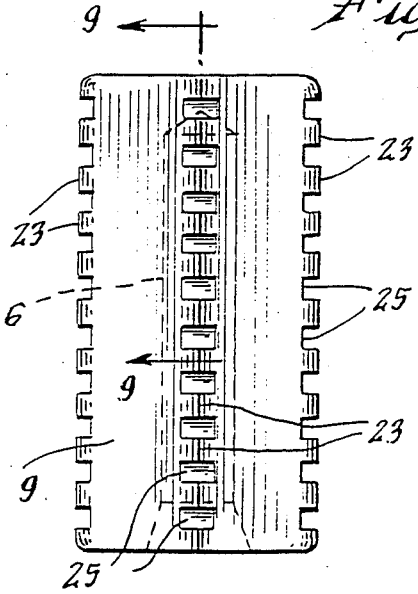
Figure 9:
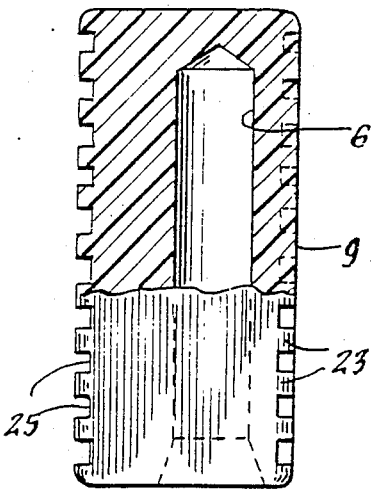
FIG. 9 is a partial section taken on line 9—9 of FIG. 8.
Figure 10:
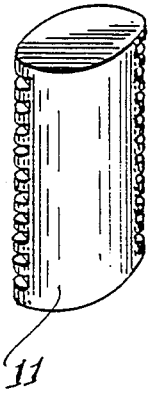
FIGS. 10 through 13 are similar, except a directed to a roller with an elliptical cross-section.
Figure 11:
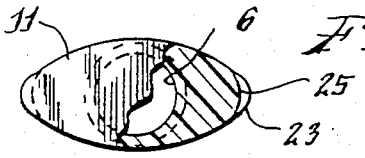
Figure 12:
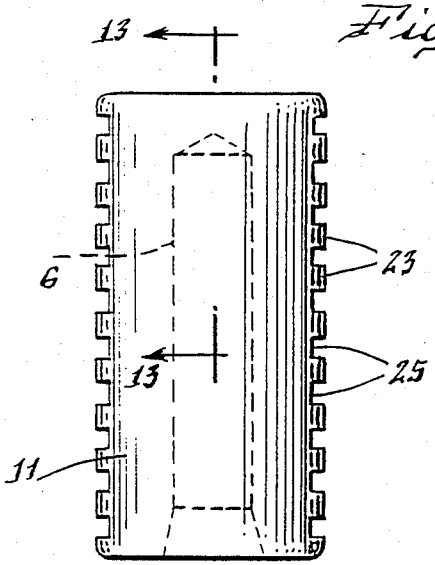
Figure 13:
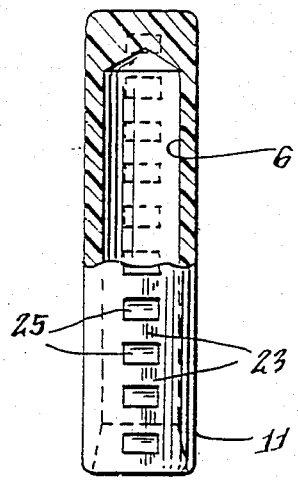
Figure 14:
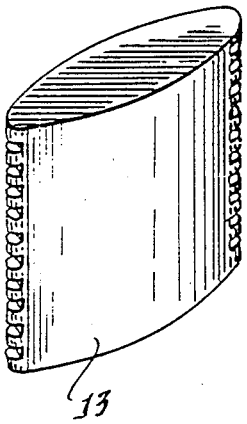
FIGS. 14 through 17 are similar except directed to an elliptical cross-section with a larger length to width ratio.
Figure 15:
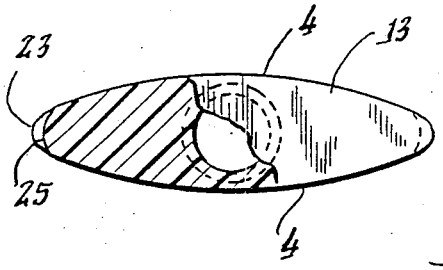
Figure 16:
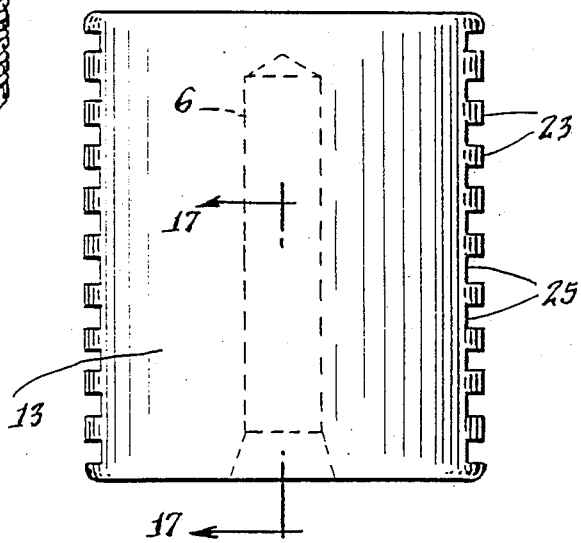
Figure 17:
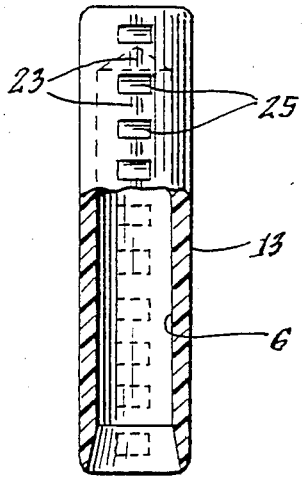

FIG. 1 shows a hair setter base 1 with a cover 3 and a plurality of heating posts 5 mounted on the base 1. The posts can be heated in any customary manner.

Mounted on the posts 5 are a series of differently shaped hair rollers each having a body and a plurality of intersecting outer surfaces 4 and an inner axial bore 6. These include small triangular rollers 7 (FIGS. 2 to 5), large triangular rollers 9 (FIGS. 6 to 9), elliptical rollers 11 (FIGS. 10 to 13), elliptical rollers with a larger length to width ratio 13 (FIGS. 14 to 17), rhombic rollers 15 (FIGS. 18 to 21), and rhombic rollers with a larger length to width ratio 17 (FIGS. 22 to 25).

It will be seen that by having these different cross-sectioned rollers on the same hair setter, the heating posts can be placed somewhat closer together, providing for a more compact unit.

Each of the rollers includes evenly spaced teeth 23 and spacings 25 between the teeth 23. These teeth may be on each axially-aligned corner edge of the rollers, as is shown for the triangular rollers 7 and 9 and the elliptical rollers 11 and 13, or may have the teeth 23 and spacings 25 only on the most acute angles of the rollers, as shown for the rhombic rollers 15 and 17. Typical teeth would be one-eighth inch wide and spaced one-eighth inch from one another.

The use of the teeth 23 and spacings 25 serves to enable the user to wrap hair evenly around the rollers. It also permits the use of rollers that do not have end flanges, thus making it easier for the user to remove hair from the rollers after the curl has set.

Each roller includes a central axial bore 6 running most of the length of the roller. This is to receive heating posts 5.

The rollers each have what I call an orthogonally asymmetric cross-section in the plane perpendicular to the axis of the roller, i.e., perpendicular to the axial bore 27. By this I mean that a line could be drawn in this plane through the axis of the bore such that the roller would be divided into two mirror images (vertical lines in FIGS. 3 and 7, and horizontal lines in FIGS. 11, 15, 19, and 23), but a second line in this plane through the axis and perpendicular to the first would not produce mirror images that are the same as the first set of images (horizontal lines in FIGS. 3 and 5, and vertical lines in FIGS. 11, 15, 19, and 23).

The use of rollers with cross-sectional shapes that are orthogonally asymmetrical results in hair that is curled in unusual and pleasing shapes. It also, as mentioned, permits the heating posts 5 to be more closely spaced than would be the case with the usual round rollers.

I claim:

1. A hair setter unit for providing unusual forms of hair curling, said hair setter including a base and a plurality of heating posts on said base, a plurality of hair rollers having axial bores therein and fitting about said heating posts, and said rollers having surfaces defining orthogonally asymmetrical cross-sections, said surfaces intersecting at intersections parallel to the axes of said bores, and at least one of said intersections having spaced teeth thereon, whereby said heating posts may be more compactly spaced.

2. A hair setter unit as set forth in claim 1 which at least some of said hair rollers have different cross-sections than other of said hair rollers and said hair rollers are intermingled on said heating posts to permit more compact spacing of said heating posts.

3. A hair setter unit as set forth in claim 1 in which at least one of said cross-sections is triangular and at least one of said cross-sections is rhombic.

4. A hair setter unit as set forth in claim 3 in which at least one of said cross-sections is elliptical.

5. A hair setter unit as set forth in claim 1 in which all of said intersections have said spaced teeth thereon.

* * * * *